United States Patent [19]

Kanamaru et al.

BEST AVAILABLE COPY

[11] 4,038,860

[45] Aug. 2, 1977

[54] PLASTIC MOLDING PROCESS FOR METAL

[75] Inventors: Hisanobu Kanamaru; Yasushi Ohuchi, both of Katsuta, Japan

[73] Assignee: Hitachi, Ltd., Japan

[21] Appl. No.: 624,057

[22] Filed: Oct. 20, 1975

[51] Int. Cl.[2] ..... B21D 22/26

[52] U.S. Cl. ..... 72/358; 72/377

[58] Field of Search ..... 72/352, 343, 358, 377

[56] References Cited

U.S. PATENT DOCUMENTS

| | | | |
|---|---|---|---|
| 1,534,299 | 4/1925 | Connery | 72/377 X |
| 3,298,219 | 1/1967 | Schober | 72/377 |
| 3,599,469 | 8/1971 | Bassoff | 72/343 |
| 3,608,350 | 9/1971 | Yamaguchi | 72/358 |

*Primary Examiner*—Gil Weidenfeld

*Attorney, Agent, or Firm*—Craig & Antonelli

[57] ABSTRACT

A plastic molding process for metal disclosed comprises the steps of: placing a blank within a first female die in contact with the teeth thereof, said female teeth being adaped to define the outer peripheral configuration of said blank, and said blank being supported on top of the female teeth of a second female die placed under said first female die; and then pressing the male teeth of a male die into said blank in a manner that the difference between the radius of a die cushion and the radius (l) of the male die as measured from the center of the male die to the bottom of a tooth groove thereof is equal to or larger than the plastic deformation δ of the blank in the radial direction, whereby the blank is molded into a desired shape, without exerting a force on the bottom or the male teeth groove.

6 Claims, 13 Drawing Figures

PLASTIC MOLDING PROCESS FOR METAL

BACKGROUND OF THE INVENTION

This invention relates to a plastic molding process for a metal suited for molding a number of teeth at least internally of a blank at a time.

As the means for molding teeth on a metal ring or grooves to form a gear, many processes are widely known, i.e., one using a gear cutter, whereby such a metal ring or a gear stock is machined into a body having teeth or grooves, and another which provides teeth or grooves in a metal ring or a gear stock according to cold extrusion. In those processes, a machining allowance must be provided for a work to be machined, and such an excessive material is scraped off, so that a work to be machined may be machined into a desired shape. This however is accompanied by increase in an amount of scraps and therefore undesirable from the viewpoint of the saving of the material resources. In the sense of economy of material resources, a below described cold extrusion process is undoubtedly affective. The cold extrusion process excels the other in forming teeth of a simple configuration, but tends to fail to provide a satisfactory result in case formation of teeth of a complicated configuration is desired. Even if satisfactory factory products may be obtained, dies used in the process is liable to underfo damage, resulting in a shortened durability, and thus the productivity is lowered.

Needless to say, it is undesirable from the viewpoint of econonmy of material resources to manufacture a product at a sacrifice of something. It is therefore desired to manufacture a product without any sacrifice, particularly, of material resources.

SUMMARY OF THE INVENTION

It is accordingly an object of the present invention to provide a process for molding teeth on a metal body, wherein consistent production of such products may be achieved and the service life of dies is extended.

It is another object of the present invention to provide a process for molding teeth on a metal body, wherein the quality of products as well as the service life of dies used are consistent and which is superior in productivity.

According to the present invention, there is provided a plastic molding process comprising the steps of; placing a blank in a female die and pressing same without exerting a force at least on the bottoms of male teeth of a male die so as to cause plastic deformation of the blank in a radially inner and outer directions of the blank or in one of these directions, whereby the blank is molded into a desired shape, with the result that material resources are saved, the service life of dies used is extended and the precision of products is enhanced.

BRIEF DESCRIPTION OF THE DRAWINGS

The accompanying drawings depict a process for manufacturing a commutator of an annular body according to the plastic molding process for a metal, according to the present invention, wherein.

DETAILED DESCRIPTION OF THE INVENTION

Figure 1:
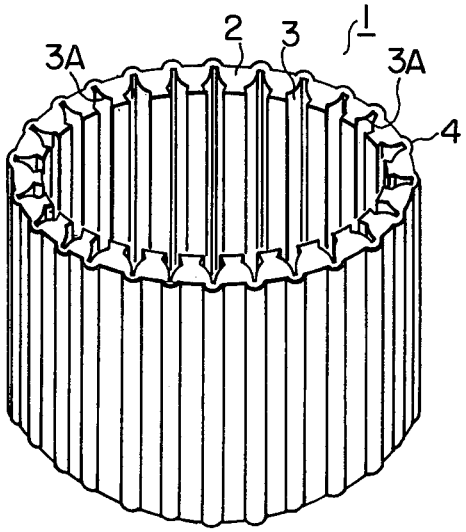
FIG. 1 is a perspective view of a finished commutator of an annular body.

Description will be given hereunder to preferred embodiments with reference to the accompanying drawings. The embodiments to be shown are a case where the process of the present invention is applied to a process for manufacturing a molded commutator of an annular body. Referring to FIG. 1, shown at 1 is a commutator of an annular body made of copper and provided with a plurality of teeth (commutator segments) 2 on the inner wall thereof. The plurality of teeth 2 are formed by providing in the inner wall of a blank a plurality of axially elongated grooves 3 having a spear-head shape in cross section, each axially elongated groove having axially elongated grooves 3A in the side walls thereof. The plurality of teeth 2 are lines of brings or build-up portions 4 on the outer circumferential surface of the body.

The commutator of an annular body 1 of the configuration described is obtained by the combination of the following steps.

Figure 3:
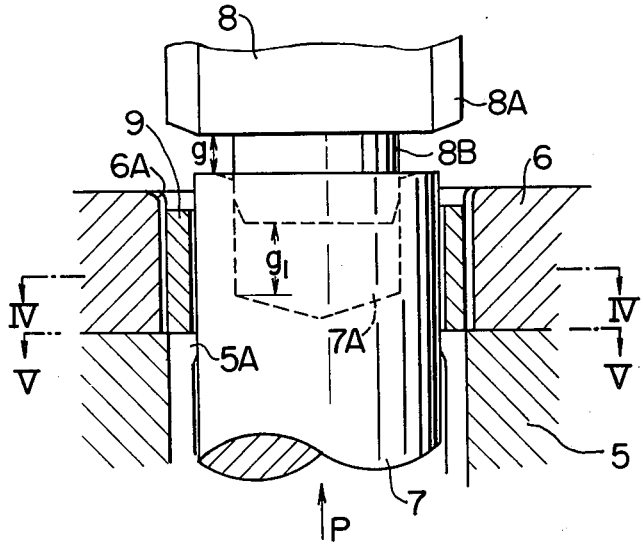
FIG. 3 illustrates the step of placing the blank in a die.
Figure 4:
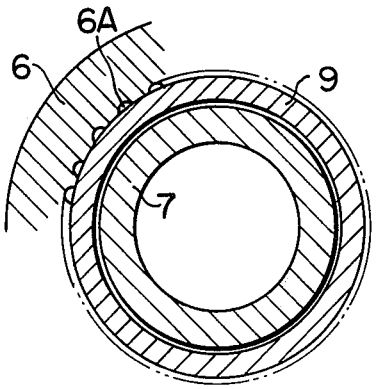
FIG. 4 is a cross sectional view taken along the line IV—IV of FIG. 3.
Figure 5:
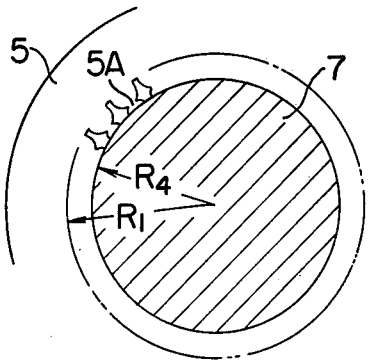
FIG. 5 is a cross sectional view taken along the line V—V of FIG. 3.

In FIG.3, shown at 5 is a second female die having female teeth 5A, on the top surface of which a first female die 6 having female teeth 6A is fixedly placed concentrically therewith. The first female die 6 must be placed on the second female die 5 with its female teeth 6A positioned radially outwards of the female teeth 5A of the latter.

Shown at 7 is a die cushion which is given a spring pressure in the direction of an arrow P and which is maintained in slidingly fitting relation to the female teeth 5A. Shown at 8 is a male die which has male teeth 8A of a spear-headed shape in cross section and whose core rod 8B is maintained slidingly fitted in a cylindrical guide cavity 7A of the die cushion 7. It is imperative that the male die 8 be positioned above the die cushion 7 with a gap $g$ being at least less than a gap $g_1$ left therebetween.

The radius $R_1$ of the male teeth 8A as measured from the center of the male die to the top of a tooth is smaller than the radius $R_2$ of the female dies 6 as measured from the bottom of a tooth groove to the center thereof, while the radius $R_3$ of the male dies as measured from the bottom of a tooth groove to the center of the male die is smaller than the radius $R_4$ of the female die 5 as measured from the bottom of tooth groove to the center thereof, yet smaller than the radius of the inner surface of the commutator of an annular body 1 which has been predetermined in the design stage.

Figure 2:
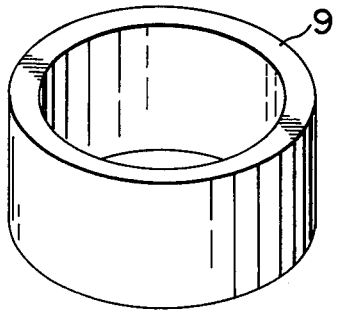
FIG. 2 is a perspective view of a blank.
Figure 6:
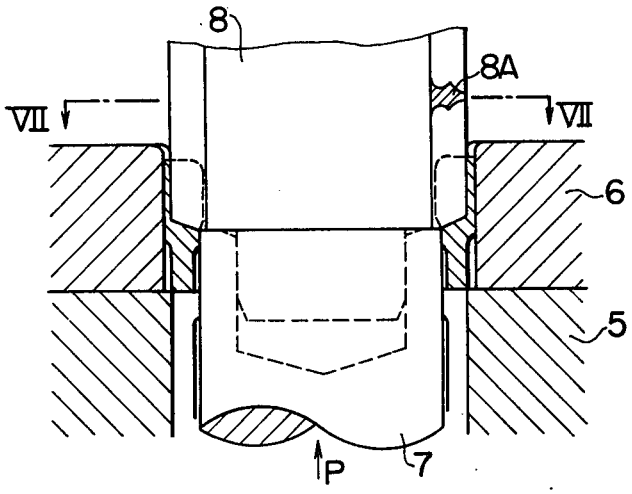
FIG. 6 illustrates the intermediate pressing step of the molding process.
Figure 7:
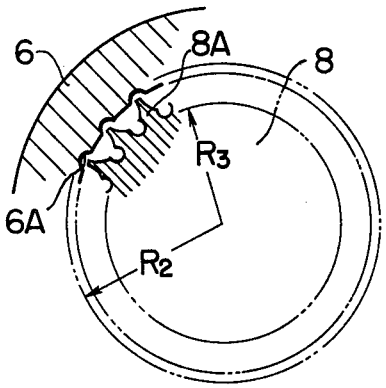
FIG. 7 is a cross sectional view taken along the line VII—VII of FIG. 6.
Figure 8:
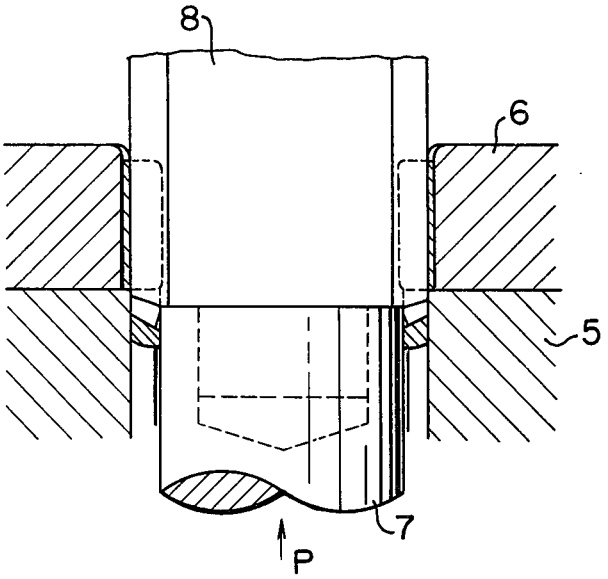
FIG. 8 illustrates the completion of the pressing step.
Figure 9:
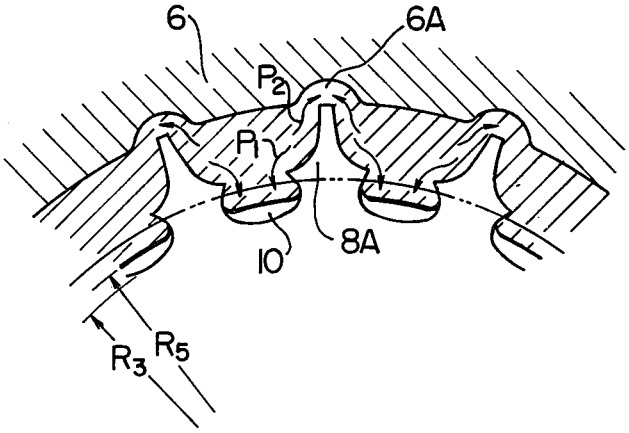
FIG. 9 is an enlarged cross sectional view of an essential part of the blank and dies, wherein plastic deformatin of the blank material is caused in the pressing step.

With the device the construction described, a blank 9 as shown in FIG. 2 is placed in the first female die 6 with its bottom surface contacting the top surface of the female teeth 5A of the second female die 5. Male die 8 is pressed downwards sownwards by means of a press machine, then the core rod 8B will be lowered along a cylindrical guide cavity 7A until the gap g between the male die 8A and the die cushion 7 becomes null. When the gap g becomes zero, the core rod 8B will be further lowered together with the die cushion 7 against the spring force of the die cushion, as seen in FIG. 6. Consequently, the male teeth 8A is forced to bite into the inner wall of the blank 9 so as to deform the blank, as a result of which the blank is subjected to shaping or plastic deformation int he direction to fill a space defined by the female die 6 and the male die 8. the status of the plastic deformation of the blank is shown in FIG. 9. As is obvious from FIG. 9, the radius R3 of the male dies 8 is smaller than the radius R5 of the inner surface of a commutator of an annular body 1 which has been predetermined in the design stage, so that a space 10 may be left therebetween.

As a consequence, when the blank 9 is pressed and deformed by the male teeth 8A, then the blank is simultaneously shaped or plastically deformed in a manner that part of the material is caused to flow into the space 10 as shown by the arrow P1 in conformity to the contour of the male teeth 8A, while the other part of the material is caused to flow into the space as shown by the arrow P2, which space is defined by the tip of each male teeth and the cavity for the female tooth 6a, without exerting any stress on the dies, whereby the blank is molded into a predetermined shape without giving a damage to the dies used.

Figure 10:
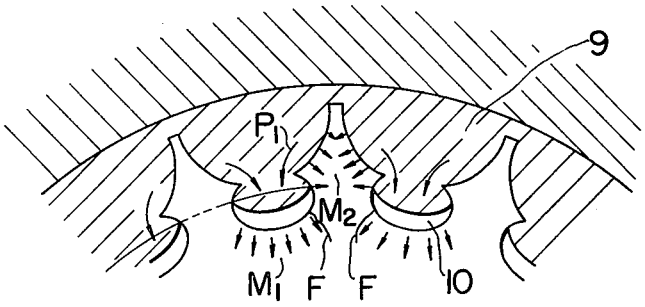
FIG. 10 is an enlarged cross sectional view of an essential part of the blank and dies according to another embodiment, wherein plastic deformation of the blank is caused in the pressing step.

The principle of the present invention will be referred to in conjucntion with FIG. 10. The space 10 is large enough, so that the blank material may not contact the bottom diameter R3 of the male die 8. Owing to the space 10, there may be avoided concentration of stress on the bottom portion of the male teeth, and therefore the bending stress M1 in the bottom portion remains at $0Kg/mm^2$. Thus, the root portion of each male tooth 8a is protected against fracture. Such bending moment is a serious obstacle to he press-molding process for a product having a complicated configuratin, particularly having teeth on the side portions thereof.

Figure 11:
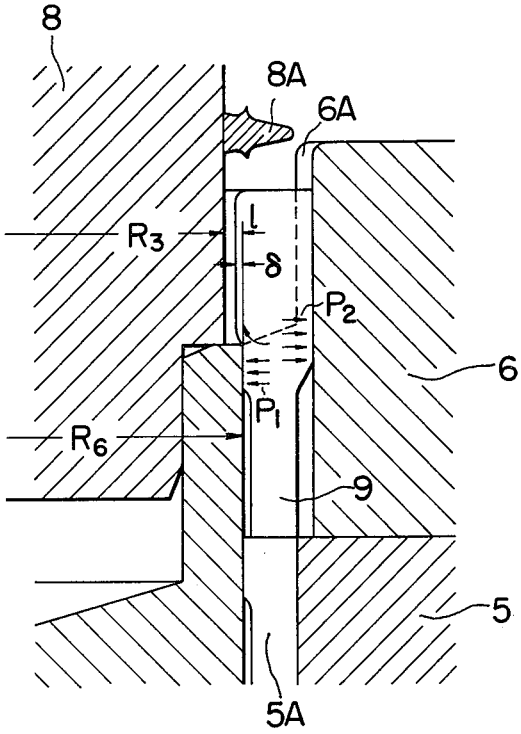
FIG. 11 is an enlarged longitudinal cross sectional view of the essential part of FIG. 6.

The status of the plastic molding for the blank is illustrated in detail in FIG. 11. There is left between the radius R3 of the male die 8 and the radius R6 of the outer surface of the die cushion 7 a space l at least larger than a width of plastic deformation of the blank. If the male teeth 8A are pressed against the blank 9, then the blank will be caused to flow into the space P1, P2 which are low in resistance until the external plastic deformation of the material is blocked by the female teeth 6A and the internal plastic deformation of the material becomes stopped, leaving a bottom space l, and thus the blank is plastically molded. The width of plastic deformation $\delta$ of the material is predetermined, based on the reltionship of the volume of the blank to be molded and the space of cavities. The blank is molded into a desired shape without contacting the bottom of male teeth 8A in the manner described. During the molding process, the die cushion 7 is maintained slidingly fitted in the female die 5 and the male die 8 is also maintained in slidingly fitting relation thereto concentrically with the die cushion, such that a gap between respective dies is maintained constant, whereby there is obtained a product uniform in thickness.

If the male die is withdrawn upwards, upon completion of the plastic molding, then the male die will be withdrawn from the die cushion together with the blank molded. The male die 8 is so arranged as to be separable from the die cushion 7 and a space is left between the blank and the male die, so that there is no risk of the molded blank being damaged at the time of the withdrawal. Simultaneously with the withdrawal of the male die 8 from the die cushion, the die cushion 7 is urged upwards under the spring action to its home position for a subsequent cycle of molding. By this time, the male die 8 has been separated from the die cushion 7 and the blank molded has been removed from the male die, so that the male die 8 may resume the position for the subsequent molding. By providing a space in the bottom of each male tooth, there is avoided a damage to the die, which has been a long-pending problem in this field, while a product high in precision is obtained at a reduced manufacturing cost, without washing material resources.

In the embodiment shown in FIG. 11, plastic deformation of the blank material is caused both internally and externally of the blank, but it will be readily understood that plastic deformation of the blank may be caused internally alone or externally alone as shown in FIG. 10, with the same result.

Figure 12:
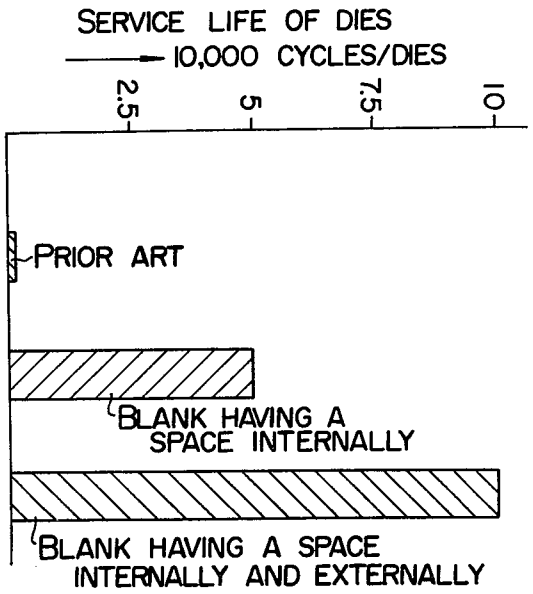
FIG. 12 is a graph presenting a comparison in the service life of dies; and, FIG. 13 shows a comparison in the amount of a material used.
Figure 13:
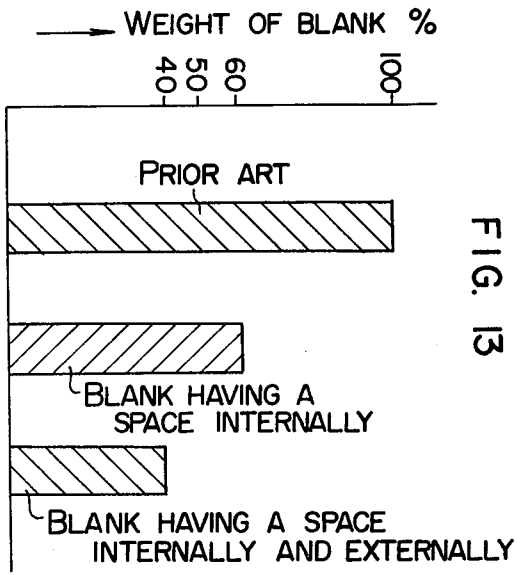

The service life of the dies used for molding the commutator of an annular body according to the process of the present invention is shown in FIG. 12 for comparison with that of the dies used for the molding process of the prior art. It will be apparent from the graph that in the case where plastic deformation of the blank is caused, with spaces left both internally and externally of the blank, the service life of the die is extended by 50 times that of the die having no such a space left according to the conventional process. Now let us compare the weights of the blank of the blanks. Assuming that the weight of a product obtained by the machining process is 100%, the weight of a blank of a product obtained by molding a blank, with spaces left both internally and externally thereof is reduced to 60%, as read from the graph of FIG. 13. This clearly tells that the latter greatly serves in economizing material resources.

The device composed of the combination of the male die and the die cushion contributes to extending the service life of the dies, and enhancing the precision of a product, as well as to improving the workability and productivity of products to a greater extent.

The embodiments are shown as the case where a commutator of an annular body is molded. The process of the present invention may be also availed for plastic-molding of an internal gear.

What is claimed is:

1. In a plastic molding process including the step of pressing a tubular blank to cause plastic deformation thereof into a product having a tooth-like configuration along at least one of the outer and inner peripheries thereof, the improvement comprising utilizing a male die having teeth around the periphery thereof and said teeth having a constant cross-sectional surface along the entire blank forming portion of the die, feeding said die axially of said blank deform and simultaneously shape the deformed material of the blank into the desired tooth-like configuration in a single deforming and shaping step providing grooves between the teeth of said die of sufficient depth so that the deformed material which flows toward the bottoms of the grooves of said teeth exerts substantially no contact force thereat.

2. A plastic molding process according to claim 1, including deforming and shaping the blank to an extent such that the deformed material of the blank which flows toward the bottoms of the grooves of the male teeth does not contact the bottoms of the grooves of the male teeth.

3. A plastic molding process according to claim 1, including providing the grooves of the male teeth of the male die with a depth sufficient to ensure that the material of the blank which flows towards the bottoms of the grooves of the male teeth does not contact the bottoms of the grooves of the male teeth during the deformation of the blank into the desired tooth-like configuration thereof.

4. A plastic molding process for metal according to claim 1, wherein the male die is pressed against the metal blank causing the metal blank to flow towards the bottoms of the grooves of the male teeth and the bottoms of the grooves of female teeth of a female die, while substantially interrupting plastic deformation of the material in the axial direction of the blank.

5. A plastic molding process for metal according to claim 1, comprising the steps of placing the metal blank within a first female die in contact with the teeth thereof, the first female die receiving the male teeth of the male die when the male die has reached the lower extremity of the stroke thereof, supporting the metal blank on the female teeth of a second female die located under the first female die, and pressing the male teeth of the male die into the metal blank to an extent that the difference between the radius of a die cushion and the radius of the male die as measured from the center of the male die to the bottom of a tooth groove of the male die is equal to or larger than the plastic deformation of the blank in the radial direction, whereby the blank is molded into the desired tooth-like configuration in a single deformation and shaping step without exerting a substantial contact force on the bottoms of the grooves of the male teeth.

6. A plastic molding process for metal according to claim 5, including providing the grooves of the male teeth within male die with a depth sufficient to ensure that the material of the blank does not contact the bottoms of the grooves of the male teeth of the male die during the deformation of the blank into the desired tooth-like configuration thereof.

* * * * *